US012736240B2

(12) United States Patent
Iuchi

(10) Patent No.: US 12,736,240 B2
(45) Date of Patent: Sep. 15, 2026

(54) AIR CONDITIONER

(71) Applicant: TOSHIBA CARRIER CORPORATION, Kanagawa (JP)

(72) Inventor: Akira Iuchi, Shizuoka (JP)

(73) Assignee: CARRIER JAPAN CORPORATION, Tokyo (JP)

( * ) Notice: Subject to any disclaimer, the term of this patent is extended or adjusted under 35 U.S.C. 154(b) by 39 days.

(21) Appl. No.: 18/722,872

(22) PCT Filed: Dec. 22, 2021

(86) PCT No.: PCT/JP2021/047634

§ 371 (c)(1),
(2) Date: Jun. 21, 2024

(87) PCT Pub. No.: WO2023/119505

PCT Pub. Date: Jun. 29, 2023

(65) Prior Publication Data

US 2025/0102171 A1 Mar. 27, 2025

(51) Int. Cl.

| | |
|---|---|
| ***F24F 11/36*** | (2018.01) |
| ***F25B 41/24*** | (2021.01) |
| ***F25B 49/02*** | (2006.01) |

(52) U.S. Cl.

CPC ..... *F24F 11/36* (2018.01); *F25B 41/24* (2021.01); *F25B 49/02* (2013.01)

(58) Field of Classification Search

CPC . F24F 11/36; F25B 41/24; F25B 49/02; F25B 2500/22

See application file for complete search history.

(56) References Cited

U.S. PATENT DOCUMENTS

2010/0280669 A1* 11/2010 Wycoff ..... F25B 49/005 700/282
2019/0346191 A1* 11/2019 Minamisako ..... F25B 41/335
(Continued)

FOREIGN PATENT DOCUMENTS

CN 202133041 U 2/2012
CN 109974192 A 7/2019
(Continued)

OTHER PUBLICATIONS

Extended European Search Report dated Oct. 6, 2025, for European Patent Application No. 21968942.9.
(Continued)

*Primary Examiner* — Nelson J Nieves
(74) *Attorney, Agent, or Firm* — KARCESKI IP LAW, PLLC

(57) ABSTRACT

An air conditioner includes a shutoff unit to shut off a flow of a refrigerant in refrigerant piping connecting an outdoor unit and an indoor unit together, a power storage unit to supply power to the shutoff unit in a case where supply of power from an external power source is shut off, a refrigerant leakage detection unit to detect a refrigerant leakage, and a power source shutoff detection unit to detect that the supply of power from the external power source is shut off. The shutoff unit includes a shutoff valve driven by a motor that shuts off the flow of the refrigerant and a valve control unit which controls an action of the shutoff valve. In a case where the refrigerant leakage is detected together with a power shutoff, the valve control unit blocks the shutoff valve and increases an action speed of the shutoff valve.

7 Claims, 7 Drawing Sheets

(56) References Cited

U.S. PATENT DOCUMENTS

| | | | | |
|---|---|---|---|---|
| 2022/0333806 | A1* | 10/2022 | Lord | F25B 49/02 |
| 2022/0390160 | A1* | 12/2022 | Fujimoto | F25B 49/02 |
| 2024/0117989 | A1* | 4/2024 | Sawamura | F24F 11/88 |
| 2024/0401827 | A1* | 12/2024 | Wada | F24F 1/32 |
| 2024/0418382 | A1* | 12/2024 | Ono | F25B 41/20 |
| 2025/0364830 | A1* | 11/2025 | Otani | F24F 11/88 |

FOREIGN PATENT DOCUMENTS

| | | | |
|---|---|---|---|
| JP | 2018036029 | A | 3/2018 |
| JP | 2020134005 | A | 8/2020 |
| JP | 2021046981 | A | 3/2021 |
| JP | 2021085643 | A | 6/2021 |
| WO | 2020110425 | A1 | 6/2020 |
| WO | 2020202465 | A1 | 10/2020 |
| WO | 2021054199 | A1 | 3/2021 |
| WO | 2021199163 | A1 | 10/2021 |

OTHER PUBLICATIONS

International Search Report dated Feb. 22, 2024, for International Patent Application No. PCT/JP2021/047634.
New Zealand Office Action dated May 6, 2026, for New Zealand Patent Application No. 812128.

* cited by examiner

AIR CONDITIONER

CROSS-REFERENCE TO RELATED APPLICATION(S)

This is a National Stage Entry into the United States Patent and Trademark Office from International Patent Application No. PCT/JP2021/047634, filed on Dec. 22, 2021, the entire content of which in incorporated herein by reference.

FIELD OF THE INVENTION

An embodiment of the present invention relates to an air conditioner.

BACKGROUND OF THE INVENTION

In related art, some air conditioners which use flammable refrigerants including slightly flammable refrigerants include a shutoff valve for shutting off a flow of a refrigerant to an indoor unit in which a leakage has occurred when a refrigerant leakage is detected by a sensor for safety. For example, Japanese Patent Laid-Open No. 2020-134005 discloses an air conditioner which includes a shutoff valve formed with an electromagnetic valve in refrigerant piping connecting an indoor unit and an outdoor unit together. Further, it has been discussed that in a case where power from an external power source supplying power to the air conditioner, in general a commercial alternating-current power source, is shutoff, a flow of a refrigerant to the indoor unit is shut off by causing the shutoff valve to act by using power from a power storage unit, and even when the refrigerant leaks from the indoor unit by any chance while the external power source is shut off, a large amount of the refrigerant with which an inside of a refrigeration cycle of the air conditioner is filled is thereby prevented from leaking.

SUMMARY OF THE INVENTION

Incidentally, when an action speed of a shutoff valve is slow, a refrigerant cannot quickly be shut off. Accordingly, it is desirable that the shutoff valve be caused to act at as high speed as possible.

However, in a case of the shutoff valve which is driven to open or close by using a motor, driving the motor at a high speed results in large power consumption. Thus, in a case where supply of power from an external power source is shut off and the shutoff valve is caused to act by using power from a power storage unit, there is a possibility that charged power of the power storage unit is decreased by power consumption in driving the motor, stored power is decreased when opening and closing of the shutoff valve are often performed in a short time, and the shutoff valve finally cannot be caused to act. Further, there is a possibility that when the shutoff valve driven by a motor is caused to act at a high speed, driving torque of the motor becomes small, a driving output to the motor is deviated from an opening of the shutoff valve, and the shutoff valve cannot accurately be caused to act and cannot completely be closed.

Accordingly, an air conditioner is provided that can quickly and certainly shut off a refrigerant in accordance with a circumstance.

An air conditioner of an embodiment includes: an outdoor unit; an indoor unit which is connected to the outdoor unit by refrigerant piping; a shutoff unit which is capable of shutting off a flow of a refrigerant in the refrigerant piping between the outdoor unit and the indoor unit; a power storage unit which is capable of supplying power to the shutoff unit in a case where supply of power from an external power source is shut off; a refrigerant leakage detection unit which detects a refrigerant leakage; and a power source shutoff detection unit which detects that the supply of power from the external power source is shut off. The shutoff unit includes a shutoff valve which shuts off the flow of the refrigerant in the refrigerant piping and a control unit which controls an action of the shutoff valve. The shutoff valve is a motor-operated valve which is driven by a motor. In a case where the refrigerant leakage detection unit detects the refrigerant leakage and a case where the power source shutoff detection unit detects that the supply of power from the external power source is shut off, the control unit blocks the shutoff valve and performs control such that an action speed of the shutoff valve in a case where the refrigerant leakage is detected becomes faster than an action speed of the shutoff valve in a case where shutoff of the supply of power from the external power source is detected.

DESCRIPTION OF EMBODIMENT(S) OF THE INVENTION

Figure 1:
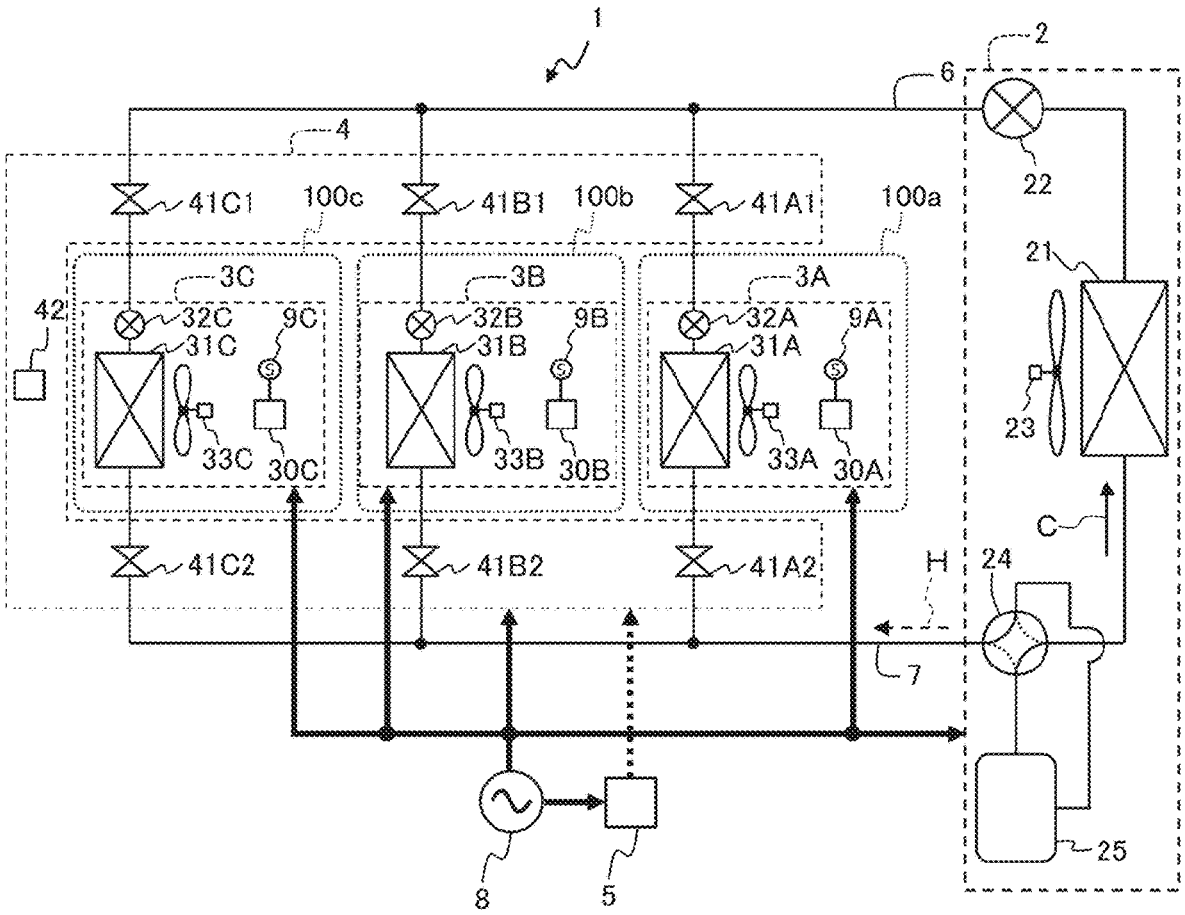
FIG. 1 is a diagram schematically illustrating an outline configuration example of an air conditioner in an embodiment.

An embodiment will hereinafter be described. As illustrated in FIG. 1, an air conditioner 1 of the present embodiment has a multi-type configuration, and for example, one outdoor unit 2 is connected to three indoor units, which are an indoor unit 3A, an indoor unit 3B, and an indoor unit 3C, by first piping 6 and second piping 7 as refrigerant piping through which a refrigerant flows. An inside of a refrigeration cycle, which is connected by the first piping 6 and the second piping 7, is filled with a flammable refrigerant, for example, a slightly flammable refrigerant HFC-R32. In addition, the air conditioner 1 includes a shutoff unit 4 which is capable of shutting off a flow of the refrigerant between the outdoor unit 2 and the indoor units 3 and a power storage unit 5. As the power storage unit 5, a lithium-ion battery which is chargeable and dischargeable is desirably used, but this is not restrictive, and a large-capacity capacitor may be used. In the following, in a case of making a description common to each of the indoor units 3, the indoor unit will simply be referred to as the indoor unit 3 without adding A, B, or C. Further, in FIG. 1, power supply paths from an external power source 8 to the outdoor unit 2, the indoor units 3, and the shutoff unit 4 are schematically illustrated by relatively bold solid lines, and a power supply path from the power storage unit 5 to the shutoff unit 4 is schematically illustrated by a relatively bold broken line.

The outdoor unit 2 and the indoor units 3 are connected together by the first piping 6 corresponding to refrigerant piping through which a liquid refrigerant mainly flows and the second piping 7 corresponding to gas refrigerant piping through which a gaseous refrigerant mainly flows. Those pieces of first piping 6 and second piping 7 correspond to a refrigerant piping system which connects the outdoor unit 2 and the indoor units 3 together. The outdoor unit 2 includes an outdoor heat exchanger 21, an outdoor expansion valve 22, an outdoor air blower 23, a four-way valve 24, a compressor 25, and so forth. However, a configuration of the outdoor unit 2 which is illustrated in FIG. 1 is one example, and a configuration is possible which includes an accumulator, a pressure sensor, and so forth, for example. Further, it is sufficient that the number of indoor units 3 is one or more, and a plurality of outdoor units 2 may further be connected in parallel in the refrigeration cycle.

The indoor unit 3 includes an indoor control unit 30, an indoor heat exchanger 31, an indoor expansion valve 32 which is provided on the first piping 6 side of the indoor heat exchanger 31, an indoor air blower 33, and so forth. The indoor control unit 30 is configured with a microcomputer which is not illustrated and controls actions of the indoor unit 3 such as start and stop of an operation and actions of the indoor expansion valve 32 and the indoor air blower 33, the actions accompanying the actions of the indoor unit 3. The indoor control unit 30 is connected to a manipulation panel, a so-called remote manipulation device, by which a starting manipulation or a stopping manipulation of an operation is input and a temperature of an air-conditioning target space 100 is set and displayed and which is not illustrated, and controls the air conditioner 1 in accordance with an instruction by the manipulation panel.

Figure 2:
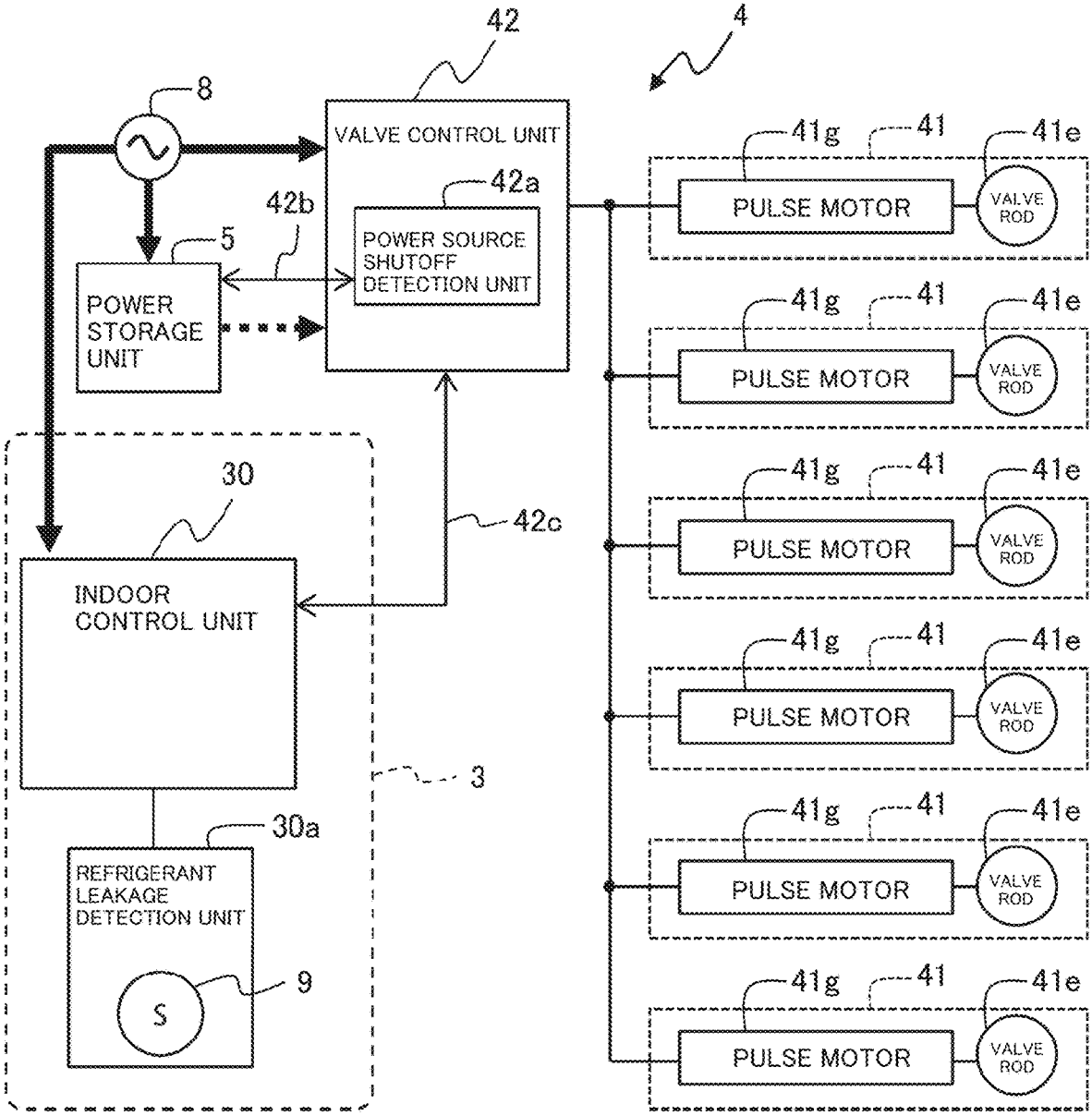
FIG. 2 is a diagram schematically illustrating an electrical configuration example of the air conditioner.

Further, as illustrated in FIG. 2, the indoor control unit 30 is connected to a refrigerant leakage detection unit 30*a*. The refrigerant leakage detection unit 30*a* includes a gas sensor 9, and when a signal indicating that the refrigerant is detected is input from the gas sensor 9, the refrigerant leakage detection unit 30*a* determines that a refrigerant leakage is occurring in the vicinity of the indoor unit 3.

Further, in the present embodiment, the gas sensor 9 is provided in the indoor unit 3, but the gas sensor 9 can be installed in the air-conditioning target space 100 in such a manner that the gas sensor 9 is installed in a lower position in the air-conditioning target space 100, for example, in order to detect a refrigerant which is in general heavier than the air. In such a case, the indoor control unit 30 and the refrigerant leakage detection unit 30*a* may be connected together by a signal cable or the like.

As illustrated in FIG. 1, in the present embodiment, the three indoor units 3A, 3B, and 3C are in parallel connected to the single refrigerant piping system. Further, in the present embodiment, it is assumed that the three indoor units 3A to 3C respectively perform air conditioning for air-conditioning target spaces 100*a* to 100*c*.

The refrigeration cycle for air conditioning for the air-conditioning target spaces 100 is constructed with those outdoor unit 2, indoor units 3, and refrigeration piping system. However, a configuration of the refrigeration cycle which is illustrated in FIG. 1, the number of indoor units 3 to be connected to the refrigeration piping system, the number of air-conditioning target spaces 100, the number of indoor units 3 to be installed in the air-conditioning target space 100, and so forth are examples, and those are not restrictive. For example, a configuration is possible in which a plurality of indoor units 3 perform air conditioning for one air-conditioning target space 100.

In a cooling operation, the air conditioner 1 switches the four-way valve 24 such that as indicated by a solid-line arrow C, the refrigerant discharged from the compressor 25 is supplied to the indoor units 3 via the outdoor heat exchanger 21, the outdoor expansion valve 22, and the first piping 6 and such that the refrigerant flowing out from the indoor units 3 returns to the compressor 25 via the second piping 7.

On the other hand, in a heating operation, the air conditioner 1 switches the four-way valve 24 such that as indicated by a broken-line arrow H, the refrigerant discharged from the compressor 25 is supplied to the indoor units 3 via the second piping 7 and such that the refrigerant flowing out from the indoor units 3 returns to the outdoor heat exchanger 21 via the indoor expansion valves 32, the first piping 6, and the outdoor expansion valve 22. Note that switching of the four-way valve 24 and an operation of the compressor 25 are controlled by an outdoor-side control device which controls the refrigeration cycle in accordance with an instruction from each of the indoor control units 30 and which is not illustrated.

The shutoff unit 4 is configured with a plurality of shutoff valves 41 which are capable of shutting off the flow of the refrigerant between the outdoor unit 2 and the indoor units 3 and a valve control unit 42 which controls actions of the above shutoff valves 41. The shutoff valve 41 is a so-called motor-operated valve which is driven by a motor and is capable of adjusting an opening. Such a motor-operated valve driven by the motor is also referred to as a PMV (pulse motor valve).

The shutoff valves 41 are respectively provided on the first piping 6 side and the second piping 7 side of each of the indoor units 3. Specifically, on the first piping 6 side of the indoor unit 3A, a shutoff valve 41A1 is provided between an indoor expansion valve 32A and the outdoor expansion valve 22, and on the second piping 7 side, a shutoff valve 41A2 is provided between an indoor heat exchanger 31A and the four-way valve 24.

Similarly, on the first piping 6 side of the indoor unit 3B, a shutoff valve 41B1 is provided between an indoor expansion valve 32B and the outdoor expansion valve 22, and on the second piping 7 side, a shutoff valve 41B2 is provided between an indoor heat exchanger 31B and the four-way valve 24. Further, on the first piping 6 side of the indoor unit 3C, a shutoff valve 41C1 is provided between an indoor expansion valve 32C and the outdoor expansion valve 22, and on the second piping 7 side, a shutoff valve 41C2 is provided between an indoor heat exchanger 31C and the four-way valve 24. Note that in a so-called simultaneous cooling-heating multi-type air conditioner in which each of the plurality of indoor units 3 can freely select cooling or heating, because the indoor units 3 are connected to the outdoor unit 2 by three pieces of refrigerant piping, in this case, the same as the number of pieces of refrigerant piping, three shutoff valves 41 are necessary for the respective indoor units 3.

Further, the air conditioner 1 causes those shutoff valves 41 to perform blocking actions and thereby becomes capable of shutting off the flow of the refrigerant between the first piping 6 and the indoor units 3 and between the second piping 7 and the indoor units 3. Accordingly, the concerned indoor unit 3 can be separated from the refrigeration cycle. In the following, in a case of making a description common to each of the shutoff valves 41, the shutoff valve will simply be referred to as the shutoff valve 41 without adding A1 or the like. The actions of those shutoff valves 41 are controlled by the valve control unit 42.

The valve control unit 42 is configured with a microcomputer or the like which is not illustrated and executes processes for controlling the actions of the shutoff valves 41. In a case of the present embodiment, the valve control unit 42 controls the actions of each of the shutoff valves 41 provided in each of the indoor units 3. In other words, in the present embodiment, a configuration is made such that the shared shutoff unit 4 is provided for the plurality of indoor units 3 which are in parallel connected to the single refrigerant piping system and as illustrated in FIG. 2, the shared valve control unit 42 performs centralized control of the actions of the shutoff valves 41 which are correspondingly provided in the indoor units 3.

Note that arrangement of the indoor units 3 is different depending on a structure of a building, and there is a case where the indoor units 3 are installed at distances. Thus, the corresponding valve control unit 42 may be provided for each of the indoor units 3, and it is also possible to install, in a combined manner, the valve control unit 42 which performs centralized control for a few indoor units 3 and the valve control unit 42 which individually controls each of the indoor units 3. Note that a portion except the external power source 8 and the indoor unit 3 in FIG. 2 corresponds to the shutoff unit 4. The valve control unit 42 is connected to the indoor control unit 30 by a communication line 42*c* and is capable of mutual exchange of signals. From the indoor control unit 30 to the valve control unit 42, a signal about refrigerant leakage detection and an opening instruction about the blocked shutoff valve 41, which will be described later, are given.

The valve control unit 42 includes a power source shutoff detection unit 42*a* which detects shutoff of supply of power from the external power source 8. The power source shutoff detection unit 42*a* is realized by combining a voltage detector of the external power source 8 and software which is provided by execution of a program by the valve control unit 42. However, a configuration is possible in which the whole power source shutoff detection unit 42*a* is realized with hardware.

The power source shutoff detection unit 42*a* monitors the supply of power from the external power source 8 and determines that a state where the supply of power from the external power source 8 is shut off is established when power from the external power source 8 is not supplied. In the following, such a state will be referred to as power source shutoff. Note that the power source shutoff is assumed to occur due to a power outage, damage to a power supply path, incorrect shutoff by a circuit breaker, or the like, for example.

The power storage unit 5 is connected to the valve control unit 42 by a signal line 42*b* and supplies power to the shutoff unit 4 when the external power source 8 is shut off due to a power outage or the like. Specifically, the power storage unit 5 is constantly charged by power supplied from the external power source 8 while the power is supplied from the external power source 8 and stores power, and the power storage unit 5 supplies the stored power to the valve control unit 42 and the shutoff valves 41 of the shutoff unit 4 based on a start instruction from the valve control unit 42 which is output via the signal line 42*b* when the power source shutoff is detected. Thus, the shutoff unit 4 is configured such that the valve control unit 42 and the shutoff valves 41 are capable of actions for a certain time even in a case where the power source shutoff occurs. In this case, in order to cause the valve control unit 42 to be capable of actions in a period until the supply of power from the power storage unit 5 is started after the external power source 8 is shutoff, for example, an auxiliary power source circuit such as a large-capacity capacitor, which is not illustrated, can be provided. Alternatively, as a configuration which constantly supplies power from the power storage unit 5 to the valve control unit 42, a configuration is possible which switches the supply of power from the external power source 8 to the shutoff valves 41 to the supply of power from the power storage unit 5 side in a case where the external power source 8 is shutoff.

Figure 5:
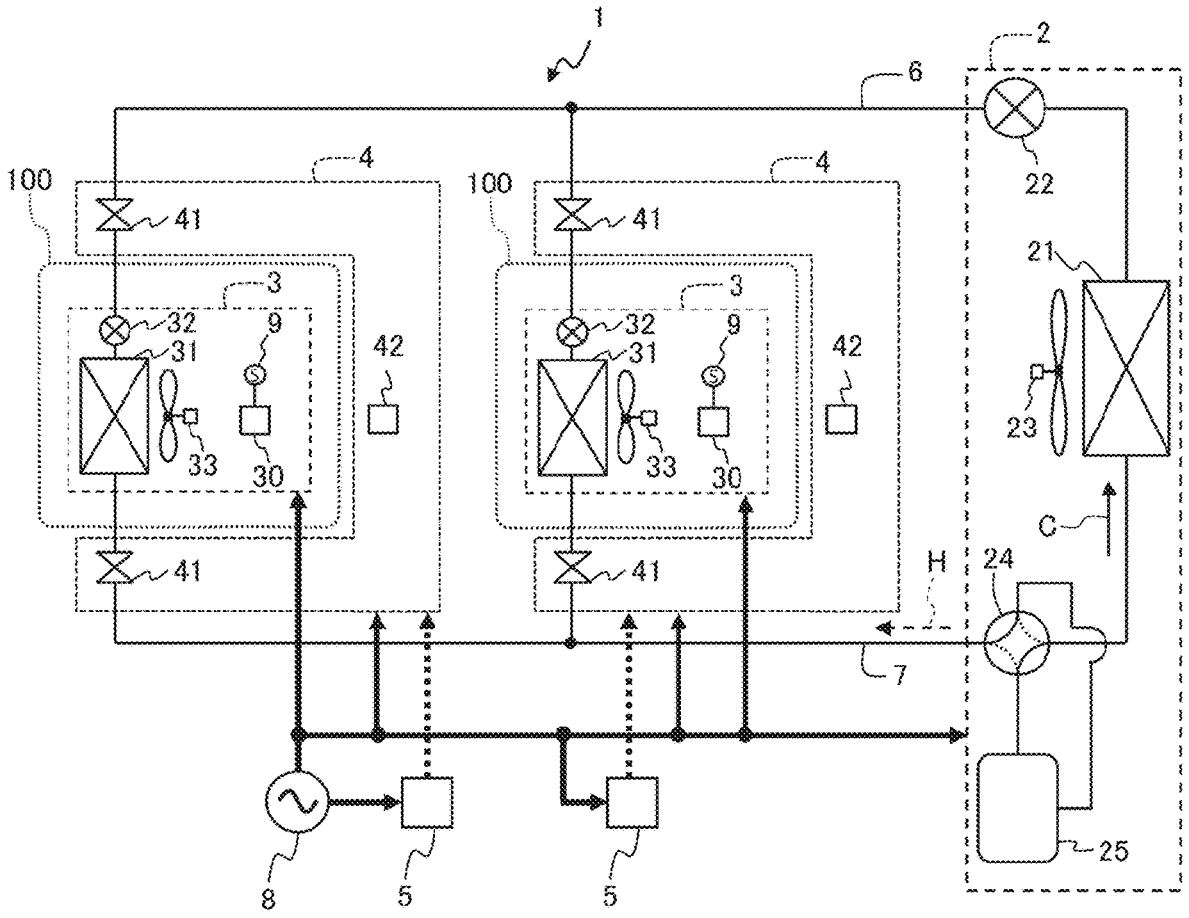
FIG. 5 is a diagram schematically illustrating another outline configuration example of the air conditioner.

Note that in FIG. 1, a configuration in which one power storage unit 5 is provided for the shutoff unit 4 is raised as an example, but a configuration is possible in which a plurality of power storage units 5 are provided for the air conditioner 1, such as a configuration in which one power storage unit 5 is provided for each of the shutoff valves 41 or a configuration in which one power storage unit 5 is provided for each of the indoor units 3 as illustrated in FIG. 5 described later, for example.

Here, details of the shutoff valve 41 will be described. The shutoff valve 41 is different from a so-called electromagnetic valve of a solenoid type and is a motor-operated valve which controls opening and closing by rotation of a motor and which is also referred to as a pulse motor valve. Thus, an action speed of the shutoff valve 41 for closing a flow path is slow compared to a common electromagnetic valve. This is due to a structure of the shutoff valve 41 as described below. Note that as a technical meaning, the action speed mentioned here means a time required until an opened flow path is closed or a time required until the closed flow path is opened. For example, this means that the action speed becomes faster as the time required until the flow path is closed becomes shorter and the action speed becomes slower as the time required until the flow path is closed becomes longer.

Figure 3:
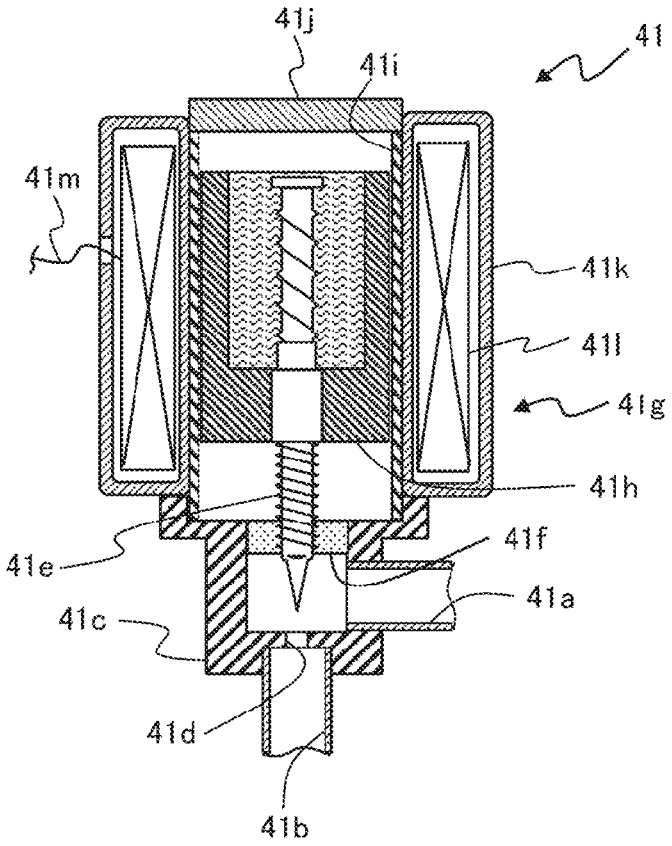
FIG. 3 is a diagram schematically illustrating a cross section of a configuration example of a motor-operated valve.

As illustrated in FIG. 3, the shutoff valve 41 includes a valve main body 41*c* which has a first connection end 41*a* serving as an entrance or an exit of the refrigerant and a second connection end 41*b* serving as an exit or an entrance of the refrigerant. Note that in a case where the first connection end 41*a* serves as the entrance of the refrigerant, the second connection end 41*b* serves as the exit of the refrigerant, and in a case where the first connection end 41*a* serves as the exit of the refrigerant, the second connection end 41*b* serves as the entrance of the refrigerant.

In the valve main body 41*c*, a valve seat 41*d* is formed which is formed to be hollow and is a cylindrical opening connected to the second connection end 41*b*. Further, the valve main body 41*c* houses a valve rod 41*e* which is arranged in a position coaxial with the valve seat 41*d* and which is relatively movable to the valve main body 41*c* in an up-down direction in FIG. 3. A surface on a distal end side of the valve rod 41*e*, which is positioned on a lower side in FIG. 3, is formed as a male screw, the valve rod 41*e* is fixed to the valve main body 41*c* and is caused to pass through a bearing portion 41*f*, and a part of the bearing portion 41*f* through which the valve rod 41*e* passes through is formed as a female screw.

Further, an upper end side of the valve rod 41*e* in FIG. 3 is fixed to a rotor 41*h* of a pulse motor 41*g*. The rotor 41*h* is a rotor which has a plurality of magnetic poles and is provided to be integrally and coaxially rotatable with the valve rod 41*e* and to be slidable in the up-down direction in FIG. 3 relatively to a casing body 41*i*.

An upper end side of the casing body 41*i* in FIG. 3 is closed by a lid member 41*j*. Further, the casing body 41*i* is positioned in an outer periphery in a range in which the rotor 41*h* is slidable, and a stator 41*k* of the pulse motor 41*g* is provided on the casing body 41*i*. The stator 41*k* is formed with a coil 41*l* as is well known, and a lead wire 41*m* which is connected to the valve control unit 42 side as illustrated in FIG. 2 is led out from the coil 41*l*.

In the shutoff valve 41 having such a configuration, a predetermined energization pulse is output to the pulse motor 41*g* when a control signal is input from the valve control unit 42 side, the rotor 41*h* having the magnetic poles thereby rotates together with the valve rod 41*e*, and because a male screw portion in an intermediate portion of the valve rod 41*e* is inserted in a female screw portion of the bearing portion 41*f*, the valve rod 41*e* moves in the up-down direction in FIG. 3 in accordance with the rotation. Note that for simplifying the description, FIG. 2 does not illustrate a driving circuit which is for driving the pulse motor 41*g* and is configured with a transistor bridge or the like, for example.

In this case, the valve rod 41*e* is arranged in a position coaxial with the valve seat 41*d*, and a distal end of the valve rod 41*e*, which is positioned on the lower side in FIG. 3, is formed into a wedge shape, for example, which is capable of being inserted in and pulled out from the valve seat 41*d*. Further, when the distal end of the valve rod 41*e* is put into the valve seat 41*d* and the valve seat 41*d* is clogged by the valve rod 41*e*, the flow path of the refrigerant between the first connection end 41*a* and the second connection end 41*b* is blocked. This state corresponds to a state where the shutoff valve 41 is closed. In the following, a position of the valve rod 41*e* in the state where the shutoff valve 41 is closed will be referred to as a stoppage position.

On the other hand, in a case where a gap is present between the valve rod 41*e* and the valve seat 41*d*, the flow path of the refrigerant between the first connection end 41*a* and the second connection end 41*b* is at least partially opened. This state corresponds to a state where the shutoff valve 41 is opened. In this case, a flow amount of the refrigerant can be adjusted by changing the position of the valve rod 41*e*.

For example, when the valve rod 41*e* is slightly lifted upward in FIG. 3 from the stoppage position, the flow path of the refrigerant is a little formed in a portion of the valve seat 41*d*. This flow path becomes larger as the valve rod 41*e* is further lifted upward in FIG. 3 and becomes a maximum when the valve rod 41*e* is completely pulled out from the valve seat 41*d*. As described above, the opening of the shutoff valve 41 can be adjusted by the position of the valve 41*e*. In the following, the position of the valve rod 41*e* which is lifted to an upper limit on the upper side in FIG. 3 will be referred to as an open position.

Next, working of the above-described air conditioner 1 will be described.

The air conditioner 1 includes the shutoff valves 41 which are capable of shutting off the flow of the refrigerant in the refrigerant piping system. Thus, for example, in a case where the refrigerant leakage to the air-conditioning target space 100 is detected, it is possible to shut off the flow of the refrigerant which flows into the indoor unit 3 and the flow of the refrigerant which flows out from the indoor unit 3. Accordingly, it can be considered that a further refrigerant leakage is inhibited and safety in the air-conditioning target space 100 can thereby be secured.

Incidentally, not only when the refrigerant leakage is detected but also when the supply of power from the external power source 8 is shut off, the air conditioner 1 has to shut off the flow of the refrigerant by causing the shutoff valves 41 to act. Thus, the power storage unit 5 is provided in the air conditioner 1, and it thereby becomes possible to shut off the flow of the refrigerant by causing the valve control unit 42 and the shutoff valves 41 to act for a certain time in a case where the external power source 8 is shutoff.

In a case where the shutoff valve 41 is blocked, there is a possibility that when the action speed of the shutoff valve 41 is slow, the refrigerant cannot quickly be shut off. Accordingly, it is desirable that the shutoff valve 41 be caused to act at as high speed as possible. On the other hand, in a case of the shutoff valve 41 which is driven to open or close by using a motor, driving the motor at a high speed results in large power consumption. As a result, in a case where the supply of power from the external power source 8 is shut off and the shutoff valves 41 are caused to act by using power from the power storage unit 5, charged power of the power storage unit 5 is rapidly decreased by power consumption in driving the motors. Thus, there is a possibility that when valve-closing actions of the shutoff valves 41 are repeatedly performed in a short time, a charge amount of the power storage unit 5 is decreased, and the shutoff valves cannot be caused to act.

In addition, there is a possibility that when the shutoff valves 41 driven by the motors are caused to act at high speeds, driving torques of the motors become small, and the shutoff valves 41 cannot be caused to accurately act and cannot completely be closed. Further, in a case where a pulse output speed of a pulse signal output from the valve control unit 42 is fast, there is a possibility that even when signals of the necessary number of pulses are output from the valve control unit 42, so-called pulse omission occurs because the rotations of the rotor 41*h* cannot respond to the number of pulses, and the shutoff valve 41 does not act to the stoppage position.

Figure 4:
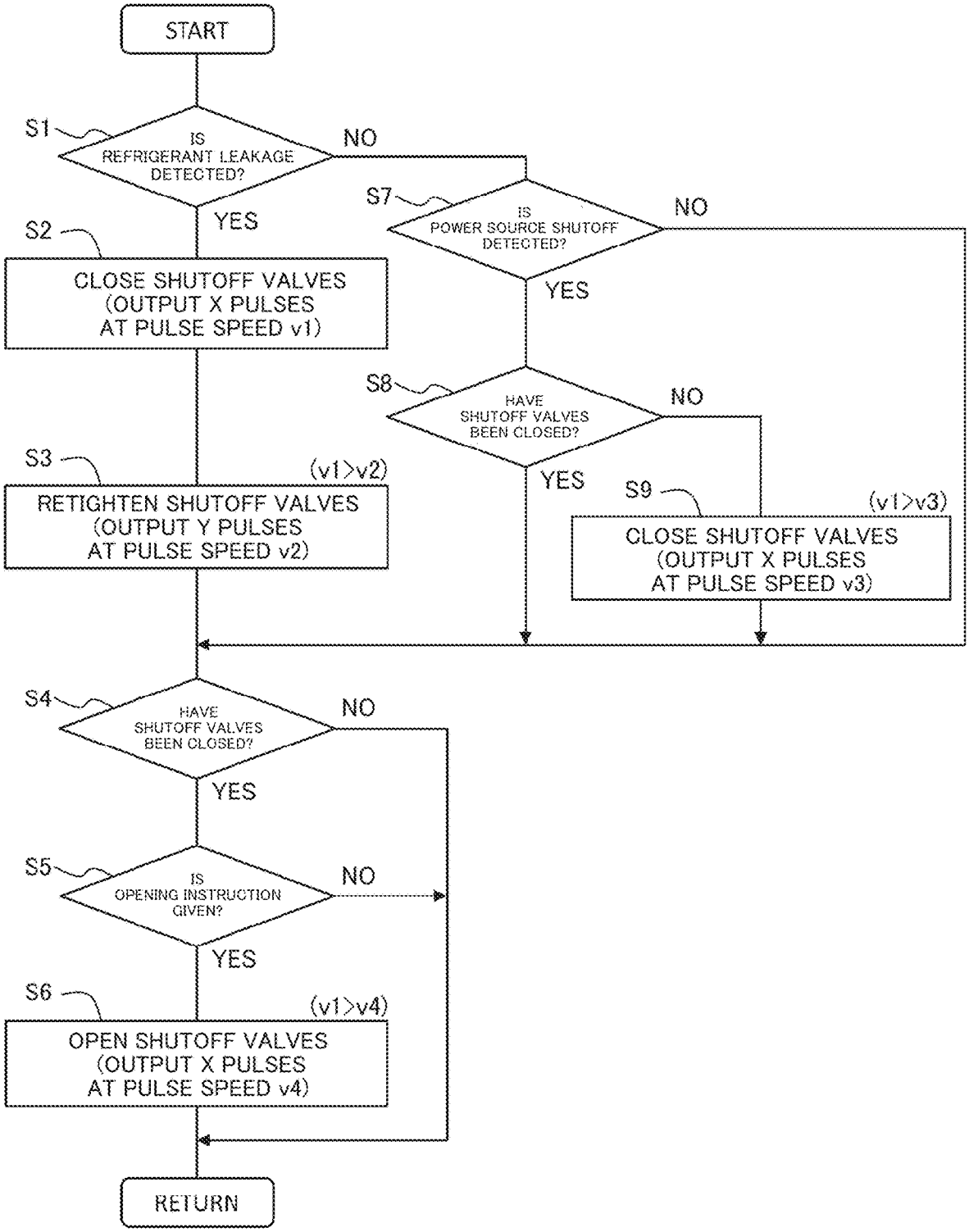
FIG. 4 is a control flowchart of a valve control unit.

Accordingly, in the air conditioner 1, the valve control unit 42 executes a process illustrated in a flowchart in FIG. 4 and is thereby enabled to quickly and certainly shut off the refrigerant in accordance with a circumstance. To put it simply, the air conditioner 1 reduces the possibility that the shutoff valve 41 cannot be caused to act and is enabled to quickly shut off the refrigerant. Note that processes illustrated in FIG. 4 are executed by the valve control unit 42 while the above-described indoor control unit 30, refrigerant leakage detection unit 30*a*, valve control unit 42, and power source shutoff detection unit 42*a* cooperate together.

In the processes illustrated in FIG. 4, the valve control unit 42 determines whether or not the refrigerant leakage is detected (S1), and in a case where the valve control unit 42 determines that the refrigerant leakage is not detected (NO in S1), the valve control unit 42 determines whether or not the power source shutoff is detected (S7). Here, detection of the refrigerant leakage means that the refrigerant leakage detection unit 30*a* detects a leakage of the refrigerant into a room and outputs a refrigerant leakage detection signal to the indoor control unit 30, the indoor control unit 30 transmits the refrigerant leakage signal indicating that a refrigerant leakage is detected to the valve control unit 42 via the communication line 42*c*, and the valve control unit 42 receives the above refrigerant leakage signal.

In a case where the valve control unit 42 determines that the power source shutoff is not detected (NO in S7), the valve control unit 42 determines whether or not the shutoff valves 41 have been closed (S4). Further, in a case where the valve control unit 42 determines that the shutoff valves 41 have been closed (YES in S4), the valve control unit 42 determines whether the opening instruction for opening the shutoff valves 41 is given (S5). Note that a case where YES is obtained in step S4 is a case where the refrigerant leakage is already detected or a power outage is already detected.

The opening instruction is performed by a notification from the indoor control unit 30 to the valve control unit 42 via the communication line 42*c*, similarly to refrigerant detection. A condition that the opening instruction be transmitted from the indoor control unit 30 is completely different between a case where the refrigerant leakage is already detected and a case where the operation is restarted after the power source shutoff. In a case where the refrigerant leakage is detected, the opening instruction is output only after the maintenance-inspection worker confirms a leakage part and repairs that part and a state is thereafter established where power is normally supplied from the external power source 8. On the other hand, in a case where the refrigerant leakage is not detected and the shutoff valves 41 are closed only due to the power source shutoff, when a state is established where power is normally supplied from the external power source 8 or after a state has been established where power is normally supplied from the external power source 8, a user gives an instruction for a restart of operation by manipulating a remote manipulation device or the like, and the opening instruction is thereby given. In either case, closing to opening of the shutoff valves 41 is carried out in a state where power is normally supplied from the external power source 8.

When the valve control unit 42 determines that the opening instruction is given from the indoor control unit 30 via the communication line 42*c* (YES in S5), the valve control unit 42 opens the shutoff valves 41 (S6). In this case, the valve control unit 42 outputs the pulse signals of X pulses to the pulse motor 41*g* at a predetermined pulse output speed (v4) and thereby opens the shutoff valve 41. As is well known, the pulse output speed denotes a frequency of the pulse signal in driving the pulse motor 41*g* and corresponds to an action speed of the shutoff valve 41. Thus, the action speed of the shutoff valve 41 becomes faster as the pulse output speed becomes faster, and the action speed of the shutoff valve 41 becomes slower as the pulse output speed becomes slower.

In this case, the pulse output speed (v4) is set slower than a pulse output speed (v1) in a case where the shutoff valve 41 is closed when the refrigerant leakage is detected. In other words, the pulse output speeds satisfy a relationship of v4<v1. Further, the number of pulses (X) to be output is the number of pulse signals which are necessary for causing the shutoff valve 41 to act from a stop position to the open position. Note that X also denotes the number of pulse signals which are necessary for causing the shutoff valve 41 to act from the open position to the stop position.

The valve control unit 42 opens the shutoff valves 41 and thereafter performs a return. Further, in a case where the valve control unit 42 determines that the shutoff valves 41 are already opened (YES in S4) and a case where the valve control unit 42 determines that the shutoff valves 41 are closed but the opening instruction is not given (NO in S5), the valve control unit 42 also performs a return. Note that it is described that a return is performed for easy understanding of a flow of the process, but the valve control unit 42 actually progresses to step S1 and repeatedly executes the above process during the action of the air conditioner 1.

Further, when the refrigerant leakage and the power source shutoff do not occur and the air conditioner 1 normally acts, that is, when the shutoff valves 41 are in an open state, in a case where the valve control unit 42 determines that the refrigerant leakage is detected (YES in S1), the valve control unit 42 outputs control signals of X pulses to the pulse motors 41*g* at the pulse output speed (v1) and thereby closes the shutoff valves 41 (S2).

In order to quickly shut off the refrigerant leakage, the pulse output speed (v1) in the above case is set fastest among other pulse output speeds in the processes. In other words, in a case where power is supplied from the external power source 8 and a case where the refrigerant leakage is detected in any one of the indoor units 3, the valve control unit 42 sets the action speed of the shutoff valve 41 as fast as possible. As a result, the concerned indoor unit 3 is quickly separated from the refrigeration cycle, and a large amount of the refrigerant with which the refrigeration cycle is filled can thereby be prevented from leaking from the above indoor unit 3 into the room.

Next, as retightening, the valve control unit 42 outputs the control signals of Y pulses to the pulse motor 41*g* at a pulse output speed (v2) and thereby certainly closes the shutoff valve 41 (S3). In this case, in order to secure a large torque, the pulse output speed (v2) is set smaller than the pulse output speed (v1). Further, it is desirable that the number of pulses (Y) be the same number as the above-described number of pulses (X) or more, for example.

In other words, the valve control unit 42 performs the retightening by a whole displacement amount of the shutoff valve 41, which is caused to act from the open position to a closed position, and thereby performs certain blocking. However, a value of the number of pulses (Y) for the retightening, which is described here, is one example and may appropriately be set in a range which is allowed by strength based on specifications of the shutoff valve 41.

Further, a process of the retightening has a technical significance as a measure against the above-described pulse omission in addition to a technical significance of certain closing of the shutoff valve 41 for prevention of the refrigerant leakage. That is, when the pulse omission occurs by any chance as a result of making faster the pulse output speed (v1) for causing the shutoff valve to quickly act, there is a possibility that the valve rod 41*e* stops while not reaching the stoppage position and cannot block the refrigerant piping and the refrigerant keeps leaking although its amount is small.

On the other hand, even if the pulse omission occurs and the valve rod 41*e* does not reach the stoppage position, the valve rod 41*e* can be moved to the stoppage position side by executing a process of the retightening in step S3. In addition, because in the process of the retightening, the control signals are output at the pulse output speed (v2) which is slower than the pulse output speed (v1), tightening torque becomes large, the valve rod 41*e* can more certainly and strongly be rotated and pressed onto the valve seat 41*d*, and the shutoff valve 41 can thereby certainly be set to a closed state.

Subsequently, the valve control unit 42 progresses to step S4. In this case, because the refrigerant leakage is detected and the shutoff valves 41 are closed, the valve control unit 42 determines that the shutoff valves 41 are closed (YES in S4). Here, when the opening instruction is not given, the valve control unit 42 determines that the opening instruction is not given (NO in S5) and performs a return.

As described above, in a case where the refrigerant leakage is detected, the valve control unit 42 executes processes in order of YES in step S1, step S2, and step S3. Further, in a case where the valve control unit 42 determines that the refrigerant leakage is not detected (NO in S1) and a case where the valve control unit 42 determines that the power source shutoff is detected (YES in S7), the valve control unit 42 determines whether the shutoff valves 41 have been closed (S8). In a case where the valve control unit 42 determines that the shutoff valves 41 have been closed, that is, in a case where the refrigerant leakage is already detected or a power outage is already detected (YES in S8), the valve control unit 42 progresses to step S4. However, because the same determination is made in step S8 and step S4, the valve control unit 42 may progress to step S5 in a case of YES in step S8.

On the other hand, in a case where the valve control unit 42 determines that the shutoff valves 41 are not closed, that is, in a case where refrigerant leakage detection is not previously made (NO in S8), the control signals of X pulses are output to the pulse motor 41*g* at a pulse output speed (v3), and the shutoff valve 41 is thereby closed (S9). In this case, the pulse output speed (v3) is set slower than the pulse output speed (v1) in a case where the shutoff valve 41 is closed when the refrigerant leakage is detected. In other words, the pulse output speeds satisfy a relationship of v4<v1, and in a case where the power source shutoff is detected, the valve control unit 42 sets the action speed of the shutoff valve 41 lower than that in a case where power is supplied from the external power source 8 and the refrigerant leakage is detected.

This is for preventing insufficient supply of power from the power storage unit 5 because in a case where the power source shutoff is detected, power for causing the shutoff valves 41 to act is supplied from the power storage unit 5. Accordingly, even in a case where power is supplied from the power storage unit 5, the valve control unit 42 is enabled to cause the shutoff valves 41 to act.

Further, in the present embodiment, the relationship among the pulse output speeds in the processes is v1>v2, v1>v3, and v1>v4. In other words, at the pulse output speed (v1), the action speed becomes fastest, and the torque becomes smallest. Further, as for the other pulse output speeds, for example, v2=v3=v4 can be set, or v2, v3, and v4 can be set to different values. In other words, the valve control unit 42 performs control such that the action speed of the shutoff valve 41 in a case where power is supplied from the external power source 8 and where the refrigerant leakage is detected becomes fastest. Note that in a normal state where neither the refrigerant leakage nor the power source shutoff is occurring, the valve control unit 42 repeats NO in step S1, NO in S7, and NO in S4, and the open state of the shutoff valves 41 is maintained.

As described above, as for the air conditioner 1, in the shutoff unit 4, control is performed such that the action speeds of the shutoff valves 41 become different between a case where power is supplied from the external power source 8 and a case where power from the power storage unit 5 is supplied. Further, as for the air conditioner 1, in the shutoff unit 4, control is performed such that the action speeds of the shutoff valves 41 become different between a case where the refrigerant leakage is detected and a case where the power source shutoff is detected. Further, as for the air conditioner 1, in the shutoff unit 4, control is performed such that the action speeds of the shutoff valves 41 become different between a case where the refrigerant leakage is detected when power is supplied from the external power source 8 and a case where the power source shutoff is detected. By those pieces of control, control of the shutoff valves 41 which corresponds to the supplied power becomes possible.

By the air conditioner 1 described above, the following effects can be obtained.

The air conditioner 1 includes the shutoff unit 4 which is capable of shutting off the flow of the refrigerant in the refrigerant piping connecting the outdoor unit 2 and the indoor units 3 together, the power storage unit 5 which is capable of supplying power to the shutoff unit 4 in a case where power from the external power source 8 is shut off, the refrigerant leakage detection unit 30*a* which detects the refrigerant leakage, and the power source shutoff detection unit 42*a* which detects that the supply of power from the external power source 8 is shut off. The shutoff unit 4 includes the shutoff valves 41 which are driven by the motors and shut off the flow of the refrigerant in the refrigerant piping and the valve control unit 42 which controls the actions of the shutoff valves 41.

Further, in a case where the refrigerant leakage is detected and a case where it is detected that the supply of power from the external power source 8 is shut off, the valve control unit 42 blocks the shutoff valves 41 and makes the action speed of the shutoff valve 41 in a case where the refrigerant leakage is detected become faster than the action speed of the shutoff valve 41 in a case where it is detected that the supply of power from the external power source 8 is shut off.

Accordingly, in a case where power is supplied from the power storage unit 5 which has a small capacity compared to power from the external power source 8, it becomes possible to cause the shutoff valves 41 to act in accordance with suppliable power. Consequently, a possibility can be reduced that the shutoff valves 41 cannot be caused to act due to a power shortage, the refrigerant can also quickly be shut off, and further the retightening for more certainly shutting off the refrigerant leakage can be performed, for example. It becomes possible to cause the shutoff valves 41 to certainly act, and the refrigerant can quickly and certainly be shut off in accordance with a circumstance.

Further, the air conditioner 1 makes the action speed in a period until the shutoff valve 41 is closed in a case where the refrigerant leakage is detected become slower than the action speed in a period until the shutoff valve 41 is closed in a case where the power is supplied from the power storage unit 5. Accordingly, the flow of the refrigerant can quickly be shut off in the refrigerant leakage, a further leakage of a flammable refrigerant can be inhibited, and safety can be improved. Note that it is desirable that the action speed be made fast in the power source shutoff, but in order to avoid, as much as possible, a worst situation where the shutoff valves cannot be manipulated due to a power shortage of the power storage unit 5 at a critical moment when the valve-closing action is necessary, the action speed in the period until the shutoff valve 41 is closed in a case where power is supplied from the power storage unit 5 is made slow.

In addition, when the refrigerant leakage is detected, the air conditioner 1 first causes the shutoff valves 41 to perform the valve-closing action at a fast action speed and thereafter carries out the retightening at a slower action speed. Accordingly, the shutoff valves 41 can certainly be closed.

Further, in the air conditioner 1 in the present embodiment, the plurality of indoor units 3 are provided in parallel in the single refrigerant piping system, the shutoff unit 4 is provided for the plurality of indoor units 3 in a shared manner, and the valve control unit 42 controls the actions of the plurality of shutoff valves 41 which are provided in each of the plurality of indoor units 3. Accordingly, control about the plurality of indoor units 3 can collectively be performed, and a possibility that a configuration becomes complicated can be reduced.

Further, the air conditioner 1 can appropriately be changed without departing from the spirit and scope thereof.

For example, as illustrated in FIG. 5, in a case where the air conditioner 1 includes a plurality of indoor units 3 in a single refrigerant piping system and where each of the indoor units 3 is installed in the different air-conditioning target space 100, the air conditioner 1 can have a configuration in which the shutoff unit 4 is provided for each of the indoor units 3. That is, in a case where the plurality of indoor units 3 are provided in parallel in the single refrigerant piping system, a configuration is possible in which a plurality of shutoff units 4 are individually provided for the plurality of indoor units 3 and the valve control unit 42 of each of the shutoff units 4 controls actions of the shutoff valves 41 which are provided for the corresponding indoor unit 3.

In a case of such a configuration, a possibility can be reduced that the shutoff valves 41 cannot be caused to act due to a power shortage, the refrigerant can also quickly be shut off, and further the retightening for more certainly shutting off the refrigerant leakage can be performed, for example. It becomes possible to cause the shutoff valves 41 to certainly act, and similar effects to those of the embodiment can be obtained such as an effect in which the refrigerant can quickly and certainly be shut off in accordance with a circumstance.

Figure 6:
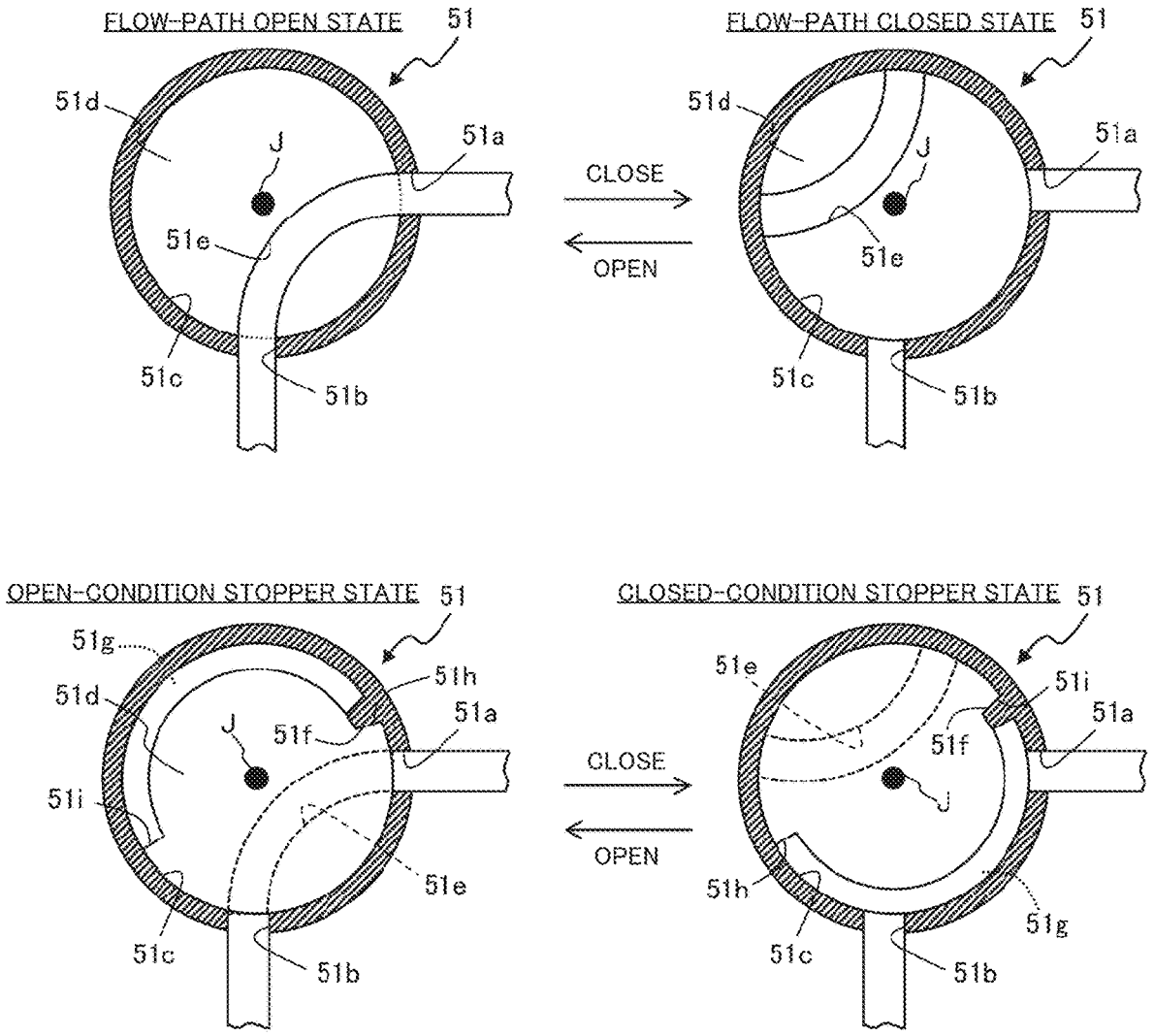
FIG. 6 is a diagram schematically illustrating cross sections of a configuration example of another motor-operated valve.

Further, in the embodiment, the shutoff valve 41 of a type in which the valve rod 41*e* is linearly moved is raised as an example, but as the shutoff valve 41, for example, an electric rotary valve 51 can be used, which is illustrated in FIG. 6 and is also referred to as a ball valve. The electric rotary valve 51 has a housing portion 51*c* which is formed with a first opening 51*a* serving as an entrance or an exit of the refrigerant and a second opening 51*b* serving as an exit or an entrance of the refrigerant and the rotating body 51*d* which is arranged in the housing portion 51*c*. In the present embodiment, the rotating body 51*d* is formed into a spherical shape, and in its internal portion, an internal flow path 51*e* is formed which is capable of connecting the first opening 51*a* and the second opening 51*b* together. Note that the rotating body 51*d* may be formed into a columnar shape which is rotatable around a rotation axis (J1) as a center.

Further, a position of the internal flow path 51*e* is changed by rotating the rotating body 51*d* around the rotation axis (J1), and switching can thereby be performed between a state where the first opening 51*a* and the second opening 51*b* are connected together by the internal flow path 51*e* and the shutoff valve 41 is thereby opened, which is illustrated as a flow-path open state, and a state where the first opening 51*a* and the second opening 51*b* are not connected together and the shutoff valve 41 is thereby closed, which is illustrated as a flow-path closed state.

In this case, as illustrated as an open-condition stopper state, the abutting portion 51*f* protruding from an inner wall to an inner periphery side is formed in the housing portion 51*c*, and a groove portion 51*g* recessed to the inner periphery side is formed in the rotating body 51*d*. Further, when the rotating body 51*d* is rotated around the rotation axis (J1), one end portion 51*h* of the groove portion 51*g* thereby contacts with the abutting portion 51*f*, and a state is established where rotation is stopped, the first opening 51*a* and the second opening 51*b* are connected together by the internal flow path 51*e*, and a state is established where the shutoff valve 41 is opened. On the other hand, when another end portion 51*i* of the groove portion 51*g* contacts with the abutting portion 51*f* from an opposite side and a state is established where rotation is stopped, the first opening 51*a* and the second opening 51*b* are not connected together by the internal flow path 51*e*, and a state is established where the shutoff valve 41 is closed.

Figure 7:
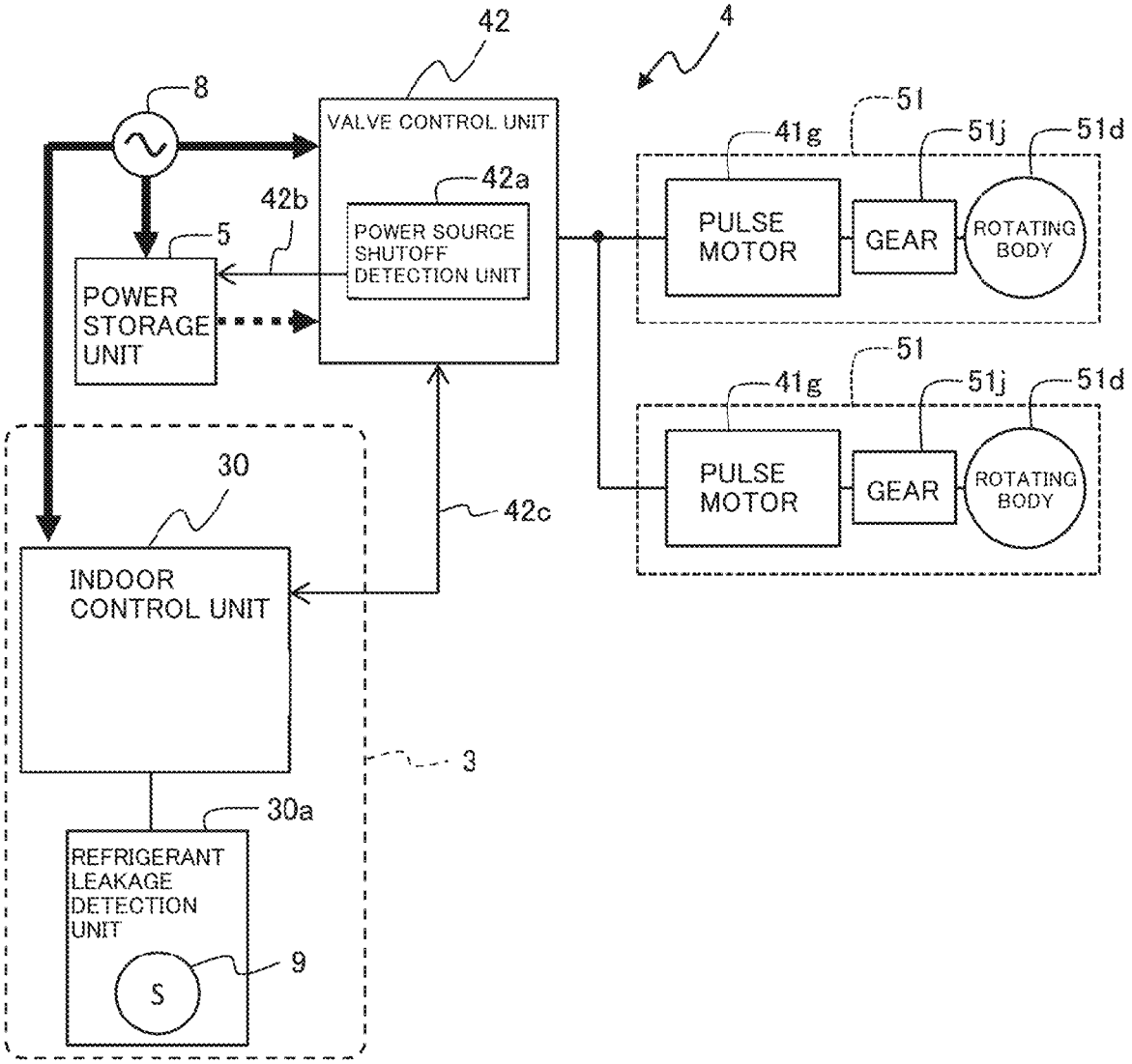
FIG. 7 is a diagram schematically illustrating another electrical configuration example of the air conditioner.

In this case, as illustrated in FIG. 7, in the shutoff unit 4, a gear 51*j* as a speed reducer is arranged on an output shaft of the pulse motor 41*g*, and a ball as the rotating body 51*d* is driven via the gear 51*j*. Accordingly, torque for causing the rotating body 51*d* to rotate while sliding on the inner wall of the housing portion 51*c* can be exerted.

In a configuration in which such an electric rotary valve 51 is used as the shutoff valve 41, control is performed such that the action speed of the shutoff valve 41 in a case where the refrigerant leakage is detected becomes faster than the action speed of the shutoff valve 41 in a case where it is detected that the supply of power from the external power source 8 is shut off, a possibility that the shutoff valves 41 cannot be caused to act due to a power shortage can thereby be reduced, and the refrigerant can also quickly be shut off, for example. Similar effects to those of the embodiment can be obtained. In other words, by the configuration of the air conditioner 1, further effects can be obtained in a case where the pulse motor valve or the ball valve which is driven by the motor via the gear 51*j* is used as the shutoff valve 41.

Further, in the embodiment, a configuration in which the dedicated valve control unit 42 is provided in the shutoff unit 4 is raised as an example, but a configuration is possible in which the indoor control unit 30 concurrently serves as the valve control unit 42, and a configuration is possible in which a control unit of a manipulation panel concurrently serves as the valve control unit 42, the control unit of the manipulation panel accepting inputs of a starting manipulation and a stopping manipulation of an operation of each of the indoor units 3 and displaying the temperature of the air-conditioning target space 100. Note that the control unit of the manipulation panel can concurrently serve as the indoor control unit 30.

Further, in the embodiment, a configuration in which the gas sensor 9 is provided in each of the indoor units 3 is raised as an example, but a configuration is possible in which a plurality of gas sensors 9 are provided in one air-conditioning target space 100. Further, the gas sensor 9 is not limited to a sensor which detects the refrigerant and can have a configuration in which the leakage is detected based on a pressure change or a flow amount change of the refrigerant or a combination of those.

The embodiments described in the foregoing are presented as examples and are not intended to limit the scope of the invention. Those novel embodiments can be carried out in other various forms, and various kinds of omission, substitutions, and changes can be performed without departing from the spirit and scope of the invention. Those embodiments and their modifications are included in the spirit and scope of the invention and are included in the invention recited in the claims and the equivalent scope thereof. Further, configurations raised as examples in the embodiments can appropriately be combined together.

The invention claimed is:

1. An air conditioner, comprising:

an outdoor unit;

an indoor unit which is connected to the outdoor unit by refrigerant piping;

a shutoff unit which is capable of shutting off a flow of a refrigerant in the refrigerant piping between the outdoor unit and the indoor unit;

a power storage unit which is capable of supplying power to the shutoff unit in a case where supply of power from an external power source is shut off;

a refrigerant leakage detection unit which detects a refrigerant leakage; and a power source shutoff detection unit which detects that the supply of power from the external power source is shut off, wherein the shutoff unit includes a shutoff valve which shuts off the flow of the refrigerant in the refrigerant piping and a control unit which controls an action of the shutoff valve, wherein the shutoff valve is a motor-operated valve which is driven by a motor, and wherein, when the refrigerant leakage detection unit detects the refrigerant leakage and when the power source shutoff detection unit detects that the supply of power from the external power source is shut off, the control unit blocks the shutoff valve and performs control such that an action speed of the shutoff valve is faster when the refrigerant leakage is detected by the leakage detection unit than when shutoff of the supply of power from the external power source is detected by the power source shutoff detection unit.

2. The air conditioner according to claim 1, wherein the refrigerant is a flammable refrigerant.

3. The air conditioner according to claim 1, wherein the control unit controls the action of the shutoff valve such that an action speed of the shutoff valve is faster when shutoff of the supply of power from the external power source is not detected by the power source shutoff detection unit than when power is supplied from the power storage unit.

4. The air conditioner according to claim 1, wherein the control unit retightens the shutoff valve in a case where the refrigerant leakage is detected by the refrigerant leakage detection unit.

5. The air conditioner according to claim 1, wherein a plurality of the indoor units are provided in parallel in a single refrigerant piping system, the shutoff unit is provided for the plurality of the indoor units in a shared manner, and the control unit controls actions of a plurality of the shutoff valves which are respectively provided in the plurality of the indoor units.

6. The air conditioner according to claim 1, wherein a plurality of the indoor units are provided in parallel in a single refrigerant piping system, a plurality of the shutoff units are individually provided for the plurality of the indoor units, and the control unit of each of the shutoff units controls the action of the shutoff valve which is provided in the corresponding indoor unit.

7. The air conditioner according to claim 1, wherein the shutoff valve is a pulse motor valve or a ball valve which is driven by a motor via a gear.

* * * * *